US005455118A

United States Patent [19]

Cook

[11] Patent Number: 5,455,118

[45] Date of Patent: Oct. 3, 1995

[54] PLATING FOR METAL MATRIX COMPOSITES

[75] Inventor: Arnold J. Cook, Mt. Pleasant, Pa.

[73] Assignee: PCC Composites, Inc., Pittsburgh, Pa.

[21] Appl. No.: 190,257

[22] Filed: Feb. 1, 1994

[51] Int. Cl.[6] ..... B22F 7/02

[52] U.S. Cl. ..... 428/555; 428/546; 428/567; 428/568; 428/553; 428/554; 428/556; 427/58; 427/125; 427/126.5; 427/126.6

[58] Field of Search ..... 164/98, 63; 419/8; 148/525; 75/204; 427/58, 125, 126.5, 126.6; 428/546, 567, 568, 553, 554, 555, 556

[56] References Cited

U.S. PATENT DOCUMENTS

| | | | |
|---|---|---|---|
| 3,107,756 | 8/1959 | Gallet | 189/36.5 |
| 4,044,816 | 8/1977 | Krueger et al. | 164/63 |
| 4,134,759 | 1/1979 | Yajima et al. | 75/204 |
| 4,980,123 | 12/1990 | Gedeon et al. | 419/8 |
| 5,163,499 | 11/1992 | Newkirk et al. | 164/98 |
| 5,211,776 | 5/1993 | Weiman | 148/525 |

*Primary Examiner*—Donald P. Walsh
*Assistant Examiner*—John N. Greaves
*Attorney, Agent, or Firm*—Ansel M. Schwartz

[57] ABSTRACT

The present invention describes a plated component and plating method in which the plating adheres to the reinforcement particles on the surface of a composite component. This allows the component to be processed above 400° C. without blistering. The plating method allows brazing, such as gold/tin and gold/germanium brazing, maintains hermeticity, and prevents corrosion over a sustained period of time. By utilizing an activator such as palladium, which can produce catalytic sites on which electroless nickel can be deposited, a component with a surface of exposed reinforcement particles can be plated to form a uniform surface without voids. It has been found that by using a combination of nickel-boron and a palladium activator, that Al/SiC composites can be plated with good adhesion when exposed to temperatures above 400° C. In addition, the present invention envisions that an activator can be used with other metal/reinforcement composites to allow the surface of exposed reinforcement material to be plated along with the metal.

15 Claims, 2 Drawing Sheets

PLATING FOR METAL MATRIX COMPOSITES

FIELD OF THE INVENTION

The present invention is related in general to plating. More specifically, the present invention is related to the plating of metal matrix composites.

BACKGROUND OF THE INVENTION

Metal matrix composite components, such as Aluminum/Silicon Carbide (Al/SiC) electronic packages, are typically plated to prevent corrosion and to allow devices to be brazed or soldered on them. For instance, composite electronic packages are normally plated with gold and then feed-throughs such as glass-to-metal feed-throughs are brazed or soldered into the package. Electric components are then bonded or soldered into the package and wire-bonded together. The package is then sealed.

Al/SiC electronic packages have been used for airborne or space borne radar systems, such as phased array tracking systems. The composite packages hold the transmitter and receiver devices which are typically made of gallium arsenide and alumina. The plating of these packages is critical to the bonding, corrosion resistance, hermeticity, and long-term reliability of the system.

An Al/SiC composite, as an example, consists of silicon carbide particles in an aluminum matrix. Different amounts of SiC particles may exist at the surface of the part, depending on the composite system and the fabrication method. A problem exists in that the SiC particles do not plate with conventional aluminum plating processes.

In an attempt to overcome the problem, many different methods have been investigated to plate Al/SiC packages. These methods have included sputtering of aluminum or other metals to create a continuous metal surface.

Standard aluminum plating processes include a zincate coating followed by an electroless coating of nickel, additional nickel, and finally a layer of gold. However, if this process is used on Al/SiC, the SiC particles will be left unplated. In some cases where the SiC particles are below 10 microns in size and comprise 50% or less of the surface area, the plating may bridge the particles and create a smooth plated surface with unbonded voids underneath. This plating, is prone to blistering at elevated temperatures above 300° C. The gap between the bridged metal and the SiC particles may trap chemicals which later react with the SiC and aluminum which causes gas evolution and blisters. Nickel phosphorous plating may leave phosphoric acid on the surface of the particles which can cause the particles to dissolve at temperatures above 200° C.

Another problem with plating composites is that the composite parts plated with standard plating processes are unable to withstand many brazing processes. Components are exposed to high temperature during the brazing and die attachment production phases. Al/SiC components are typically assembled with gold/tin or gold/germanium brazes. These brazes typically require a temperature exposure of 300° to 400° C., respectively. Al/SiC packages plated with standard aluminum plating processes tend to blister above 350° C. Composite components which are brazed typically fail to maintain hermeticity and corrode upon long term exposure. These failures are due to interconnecting porosity found around the SiC particles. Corrosion and blistering cause failure to eventually occur even if the packages were hermetic when assembled.

SUMMARY OF THE INVENTION

The present invention describes a plating component and plating method in which the plating adheres to the reinforcement particles on the surface of a composite component. This allows the component to be processed above 400° C. without blistering. The plating method allows brazing, such as gold/tin and gold/germanium brazing, maintains hermeticity, and prevents corrosion over a sustained period of time.

By utilizing an activator such as palladium, which can produce catalytic sites on which electroless nickel can be deposited, a component with a surface of aluminum and exposed SiC particles can be plated to form a uniform surface without voids. It has been found that by using a combination of nickel-boron and a palladium activator, that Al/SiC can be plated with good adhesion when exposed to temperatures above 400° C.

In addition, the present invention envisions that an activator can be used with other metal/reinforcement composites to allow the surface of exposed reinforcement material to be plated along with the metal.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1A:
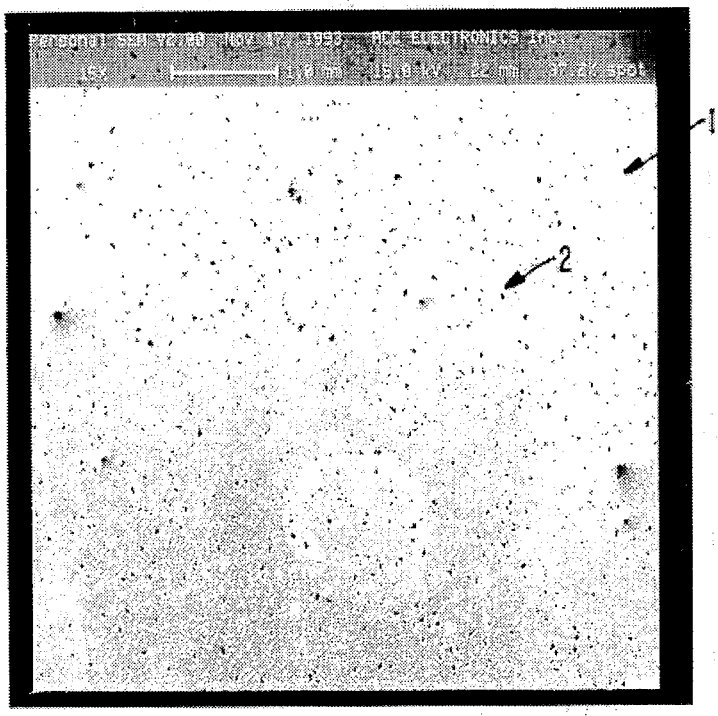
FIGS. 1*a* and 1*b* are micrographs of an Al/SiC package plated with a standard aluminum plating process which has unplated SiC reinforcement particles on the surface.
Figure 1B:
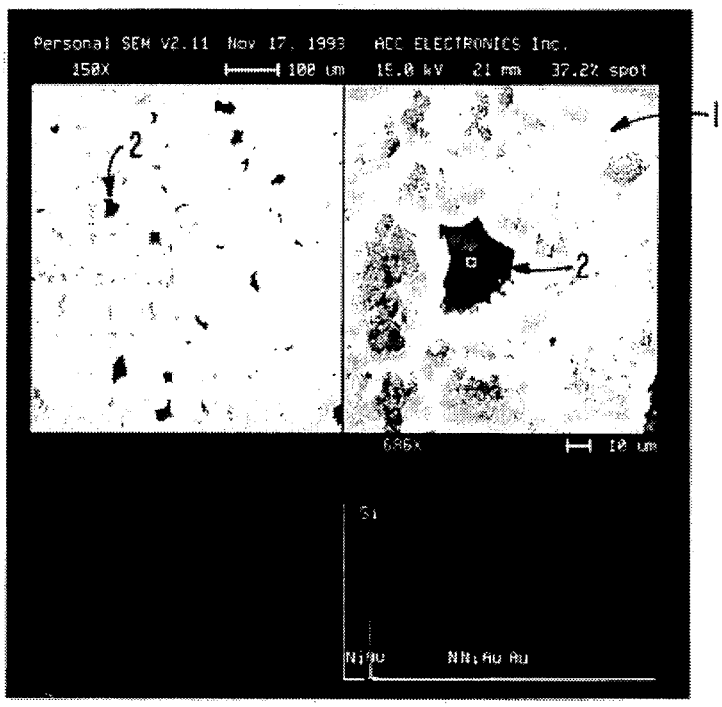

Referring now to the drawings wherein like reference numerals refer to similar or identical parts throughout the several views, and more specifically to figures 1*a* and 1*b* thereof, there is shown a typical prior art metal matrix composite 10 with exposed reinforcement particles 12 on the surface which has been plated according to normal plating processes. In this specific example, the composite 10 is comprised of aluminum/SiC. SiC reinforcement particles 12 are left unplated as seen in FIGS. 1A and 1B.

Normal plating of cast aluminum typically requires the following steps prior to nickel and/or gold plating:

Step 1) Bake to remove entrapped oils or other chemicals from the surface.

Step 2) Soak in a mild alkaline, non-etching cleaner.

Step 3) Etch clean.

Step 4) Desmut in a 50% nitric acid solution.

Step 5) Zincate.

Step 6) Zincate strip.

Step 7) Rezincate.

Step 8) Electroless nickel.

Electroless nickel typically requires a heat treatment of 250° to 375° F. for 1 to 2 hours to increase plating adhesion. This process has produced poor results with metal matrix composites.

The present invention is a method of plating a metal matrix composite 10. The method comprises the step of applying an activating material to a surface of the composite 10 to activate exposed reinforcement 12 to accept plating. Then, there is the step of depositing a plating material over the activating material on the composite 10 so that the plating material plates and adheres to the reinforcement 12.

Preferably, the activating material is comprised of an inert metal in Group VIII of the periodic table, such as palladium. Preferably, before the disposing step, there is the step of depositing a zincate coating to the surface of the composite 10. Preferably, before the applying step, there is the step of mixing the activator coating in a liquid solution, such as hydrochloric acid.

Figure 2:
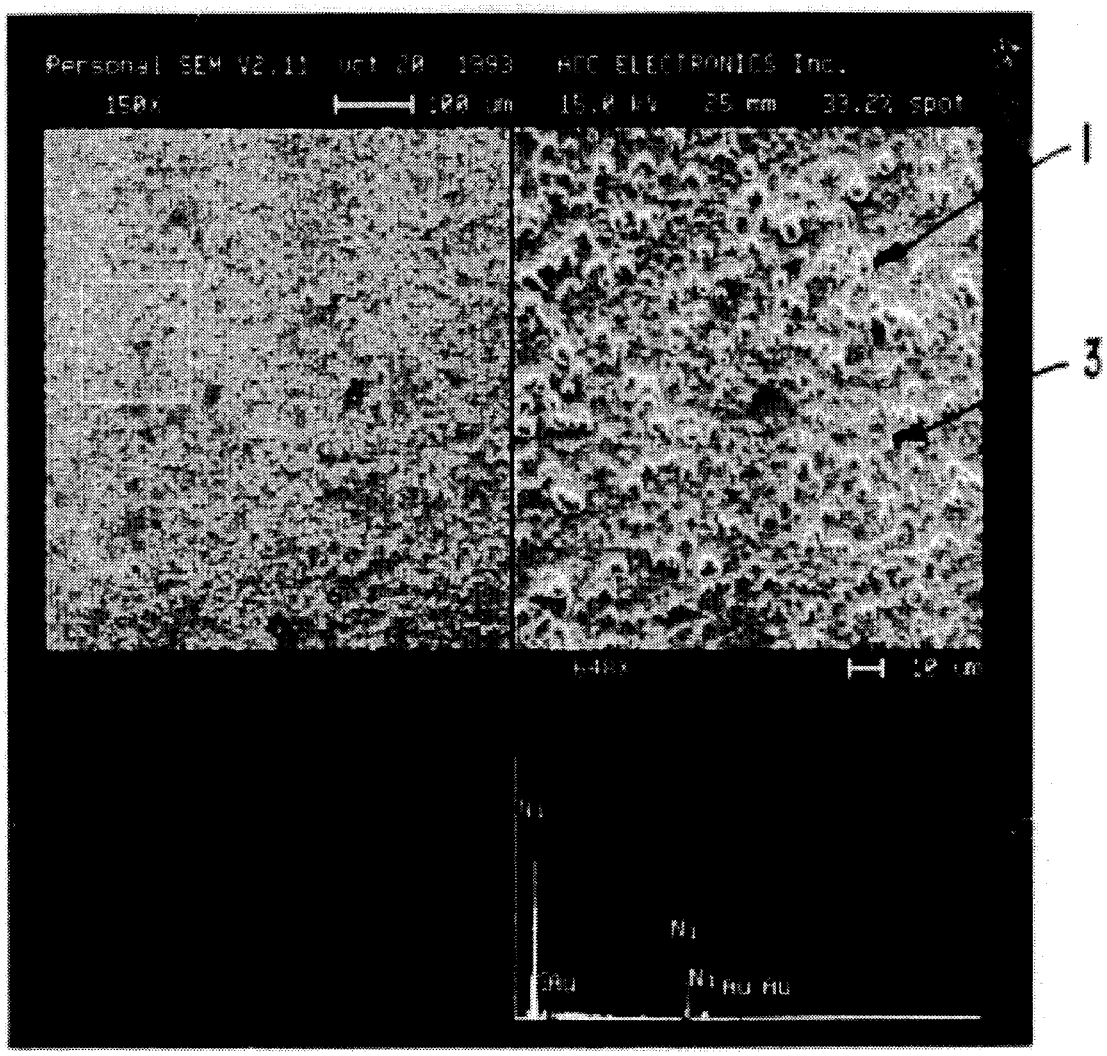
FIG. 2 is a micrograph showing an Al/SiC package plated with a palladium activator which does not have any exposed SiC particles.

FIG. 2 shows a composite 10 which palladium has been used to activate the exposed SiC particles 12 to allow the entire surface to be coated with electroless nickel to form a continuous plating surface 13. The Al/SiC composite shown in FIG. 2 was subsequently plated with a nickel and gold plating for electronic packaging applications.

The present invention, as shown in FIG. 2, is also a metal matrix composite 10 comprising a component comprised of a reinforcement material 12 and a matrix material infiltrated with the reinforcement material 12. There is a coating of activator material disposed over exposed reinforcement material 12 on a surface of the component. There is also a layer comprised of plating material disposed over the activator material. The activator coating activates the exposed reinforcement material 12 to bind with it. The plating in turn binds with the activator layer. In this way, the plating is securely held in place on the composite.

In one embodiment, an Al/SiC composite package is cleaned with an acid etch, followed by an acid salt, followed by a first zincate. This zincate is then stripped with nitric acid and a new zincate layer is added, followed by an electroless nickel-boron layer, palladium activator coating, and additional electroless nickel-boron. After this nickel-boron step, conventional electrolytic nickel such as nickel-boron and gold plating may be used.

Table 1 lists the steps involved with a specific embodiment of the invention. The described plating method can be performed with off-the-shelf chemicals such as available from Shipley Chemical Company in Newton, Mass. Electroless boron-nickel and an acid/palladium activator solution is used to promote plating on the exposed reinforcement 12. The palladium is in a hydrochloric acid base which produces catalytic sites on the electroless nickel deposit layer.

TABLE 1

| | |
|---|---|
| Step 1 | 10 minute soak DP 120 at 130° F. |
| Step 2 | Cold water rinse |
| Step 3 | 2 minute acid etch DP 320 at 120° F. |
| Step 4 | Cold water rinse |
| Step 5 | 15 second acid/salt DP 420 at room temperature |
| Step 6 | Cold water rinse |
| Step 7 | 20 second zincate DP 520 at room temperature |
| Step 8 | Cold water rinse |
| Step 9 | 18 minute electroless boron nickel 468 at 160° F. |
| Step 10 | Cold water rinse |
| Step 11 | 1 minute activator act 472 at room temperature |
| Step 12 | Cold water rinse |
| Step 13 | 30 minute electroless boron nickel 468 at 160° F. |
| Step 14 | Cold water rinse |
| Step 15 | Nickel and gold plate as required |

It should be appreciated that this process may be used for initiating the plating process on a wide variety of metal/reinforcement composites including aluminum, copper, magnesium, and nickel and iron-based matrix composites.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A method of plating a metal matrix composite comprising the steps of:

applying an activator material to reinforcement on the surface of the composite to activate the reinforcement to accept plating; and depositing a plating material over the activating material on the composite so that the plating material plates and adheres to the reinforcement.

2. A method as described in claim 1 wherein the activator material is comprised of a material in Group VIII of the periodic table.

3. A method as described in claim 2 wherein the activator material is comprised of palladium.

4. A method as described in claim 3 wherein before the step of applying activator, there is the step of disposing a layer comprised of nickel on the composite.

5. A method as described in claim 4 wherein after the step of applying activator, there is the step of providing a layer comprised of nickel over the activator material.

6. A method as described in claim 5 wherein before the step of disposing a layer comprised of nickel, there is the step of disposing a zincate coating to the surface of the composite.

7. A method as described in claim 6 wherein before the applying step, there is the step of mixing the activator material in a liquid solution.

8. A method as described in claim 7 wherein before the step of disposing the zincate material, there is the step of cleaning the surface of the composite.

9. A metal matrix composites comprising:

a component comprised of a reinforcement material and a matrix material infiltrated with the reinforcement material;

a coating of activator material disposed over exposed reinforcement material on a surface of the component; and plating disposed over the coating of activator material, said coating of activator material activating the exposed reinforcement material to accept and adhere to the plating.

10. A composite as described in claim 9 wherein the reinforcement material is comprised of ceramic and the matrix material is comprised of metal.

11. A composite as described in claim 10 wherein the reinforcement material is comprised of silicon carbide particles and the matrix material is comprised of aluminum.

12. A composite as described in claim 11 wherein the activator coating is comprised of an element from Group VIII of the periodic table.

13. A composite as described in claim 12 wherein the activator coating is comprised of palladium.

14. A composite as described in claim 13 including a layer comprised of nickel disposed between the component and the activator coating.

15. A composite as described in claim 14 including a layer comprised of nickel disposed between the activator coating and the plating.

* * * * *